US010965009B2

(12) United States Patent
Hammond et al.

(10) Patent No.: US 10,965,009 B2
(45) Date of Patent: Mar. 30, 2021

(54) CAPACITIVELY COUPLED LABEL ANTENNA

(71) Applicant: Flex Ltd., Singapore (SG)

(72) Inventors: Robert R. B. Hammond, Manotick (CA); Yitzchak Shpitzer, Haifa (IL); Mark J. Fordham, Chapel Hill, NC (US); Frank William Dopplinger, Nepean (CA)

(73) Assignee: Flex Ltd., Singapore (SG)

( * ) Notice: Subject to any disclaimer, the term of this patent is extended or adjusted under 35 U.S.C. 154(b) by 0 days.

(21) Appl. No.: 16/598,673

(22) Filed: Oct. 10, 2019

(65) Prior Publication Data

US 2020/0119431 A1 Apr. 16, 2020

Related U.S. Application Data

(60) Provisional application No. 62/743,952, filed on Oct. 10, 2018.

(51) Int. Cl.

| | |
|---|---|
| ***H01Q 1/24*** | (2006.01) |
| ***H01Q 1/28*** | (2006.01) |
| ***H01Q 1/52*** | (2006.01) |

(52) U.S. Cl.

CPC ..... *H01Q 1/243* (2013.01); *H01Q 1/28* (2013.01); *H01Q 1/521* (2013.01)

(58) Field of Classification Search

CPC ..... H01Q 1/24; H01Q 1/243; H01Q 1/2208; H01Q 1/521; H01Q 9/265

See application file for complete search history.

(56) References Cited

U.S. PATENT DOCUMENTS

| | | | | |
|---|---|---|---|---|
| 9,064,163 | B2 * | 6/2015 | Phaneuf | G06K 17/0029 |
| 10,069,202 | B1 | 9/2018 | Gorcea | |
| 2014/0184390 | A1 * | 7/2014 | Elizondo, II | G06K 19/07786 340/10.1 |
| 2018/0253632 | A1 * | 9/2018 | Uland | H01L 23/544 |

* cited by examiner

*Primary Examiner* — Hoang V Nguyen
(74) *Attorney, Agent, or Firm* — Sheridan Ross P.C.

(57) ABSTRACT

The methods, systems, and devices of the present disclosure are directed to a capacitively coupled label antenna as a component in an antenna system comprising the label antenna, a feed block, an antenna coupler, and a gap between the antenna coupler and the feed block. The label antenna is electrically connected to the antenna coupler, and the antenna coupler is capacitively coupled to the feed block through the gap. By the addition of the gap between the feed block and antenna coupler, the label antenna may be placed on the surface of a container without requiring a wired connection to pass through the container. The feed block may be a small electronic component on a circuit board while the label antenna may be significantly larger thereby providing increased frequency bandwidth and an improved antenna radiation pattern.

20 Claims, 13 Drawing Sheets

CAPACITIVELY COUPLED LABEL ANTENNA

CROSS REFERENCE TO RELATED APPLICATION

The present application claims the benefits of and priority, under 35 U.S.C. § 119(e), to U.S. Provisional Application Ser. No. 62/743,952, filed on Oct. 10, 2018, entitled "Capacitively Coupled Label Antenna." The entire disclosure of the application listed above is hereby incorporated by reference, in its entirety, for all that it teaches and for all purposes.

FIELD

The present disclosure is generally directed to the transfer of RF energy to an antenna without the use of wires, and more specifically to methods, systems, and devices directed to capacitively coupled label antennas.

BACKGROUND

Small portable electronic devices commonly need to communicate with other devices and networks, such as a device that is part of a system of interrelated devices embodied by the Internet of Things (IoT) or the Internet of Medical Things. Small devices may have limited area for an antenna, and other devices may have a conductive case that limit antenna performance. By using a label antenna on the exterior of an electronic device or container and coupling the label antenna to a feed block within the device or container, a wired connection through the exterior of the device or container is not required. The feed block may be designed to have a smaller volume, and components and traces may be located beneath the feed block. A label antenna may be significantly larger than the feed block and may be adjusted to a desired center frequency and bandwidth by varying the size, volume, and shape of the label antenna. A label antenna has improved radio frequency (RF) radiation performance when compared to conventional ceramic chip antennas, etched monopole antennas, or laser directed structuring (LDS) plated antennas of similar volumes. A label antenna also has the advantage of using an existing label for a secondary purpose. Example applications include attaching or wrapping the label antenna to the outer surface of a container (e.g., medicine bottle, shipping container/box, and/or other container), or the outer surface of a home appliance (e.g., microwave oven, refrigerator, washing machine, clothes dryer, and/or the like).

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

Figure 1:
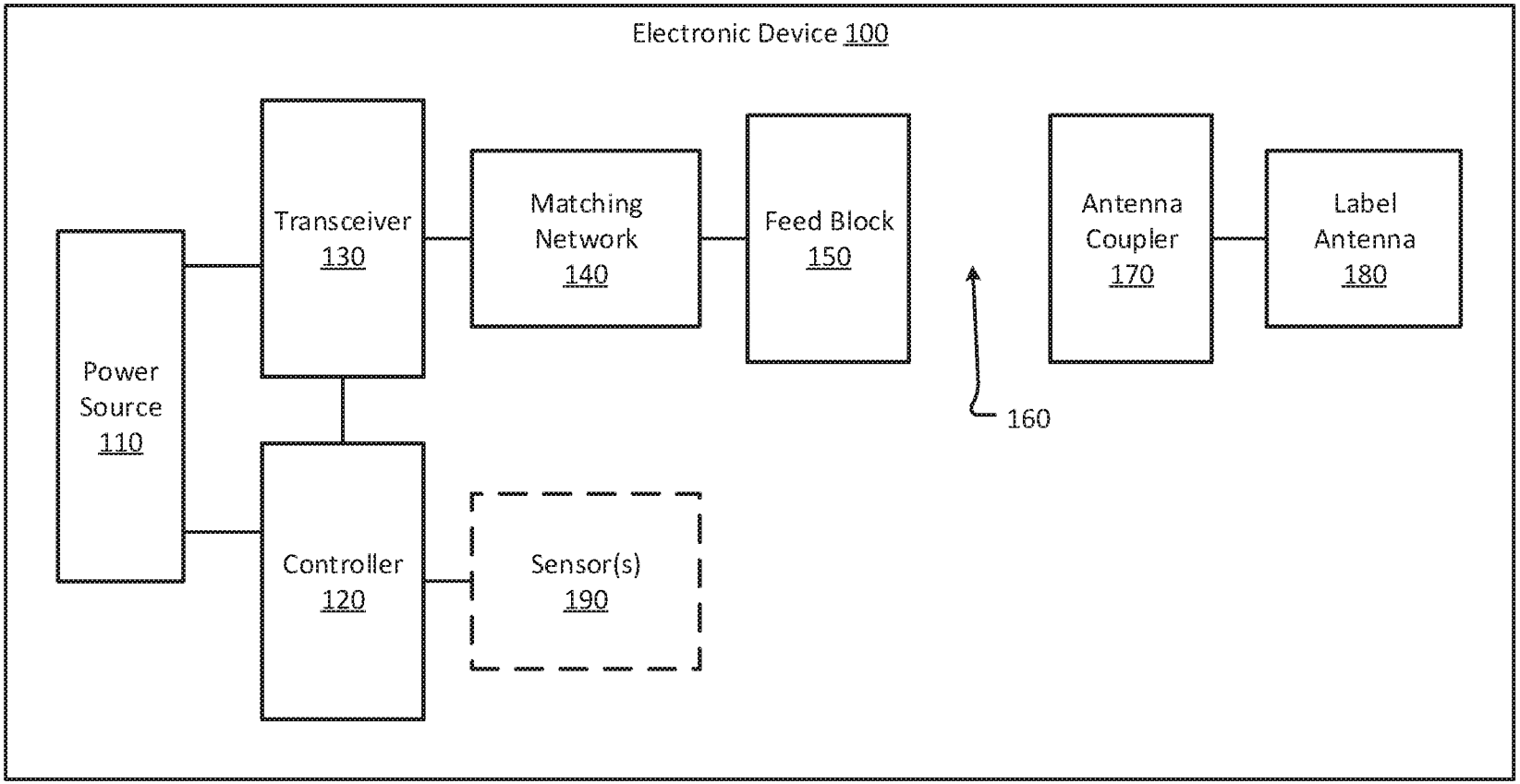
FIG. 1 is a block diagram of an electronic device in accordance with at least one embodiment of the present disclosure.

Before any embodiments of the disclosure are explained in detail, it is to be understood that the disclosure is not limited in its application to the details of construction and the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the present disclosure may use examples to illustrate one or more aspects thereof. Unless explicitly stated otherwise, the use or listing of one or more examples (which may be denoted by "for example," "by way of example," "e.g.," "such as," or similar language) is not intended to and does not limit the scope of the present disclosure.

FIG. 1 is a block diagram of an electronic device 100. The electronic device 100 comprises a power source 110, a controller 120, a transceiver 130, a matching network 140, a feed block 150, a gap 160, an antenna coupler 170, a label antenna 180, and (optionally) a sensor(s) 190.

The power source 110 provides power to the controller 120 and the transceiver 130. The negative terminal of the power source 110 also provides the circuit ground for other components, including providing the ground for the ground plane for the feed block 150 and/or the label antenna 180. The power source 110 may comprise one or more batteries or battery cells, or other power source.

Figure 12:
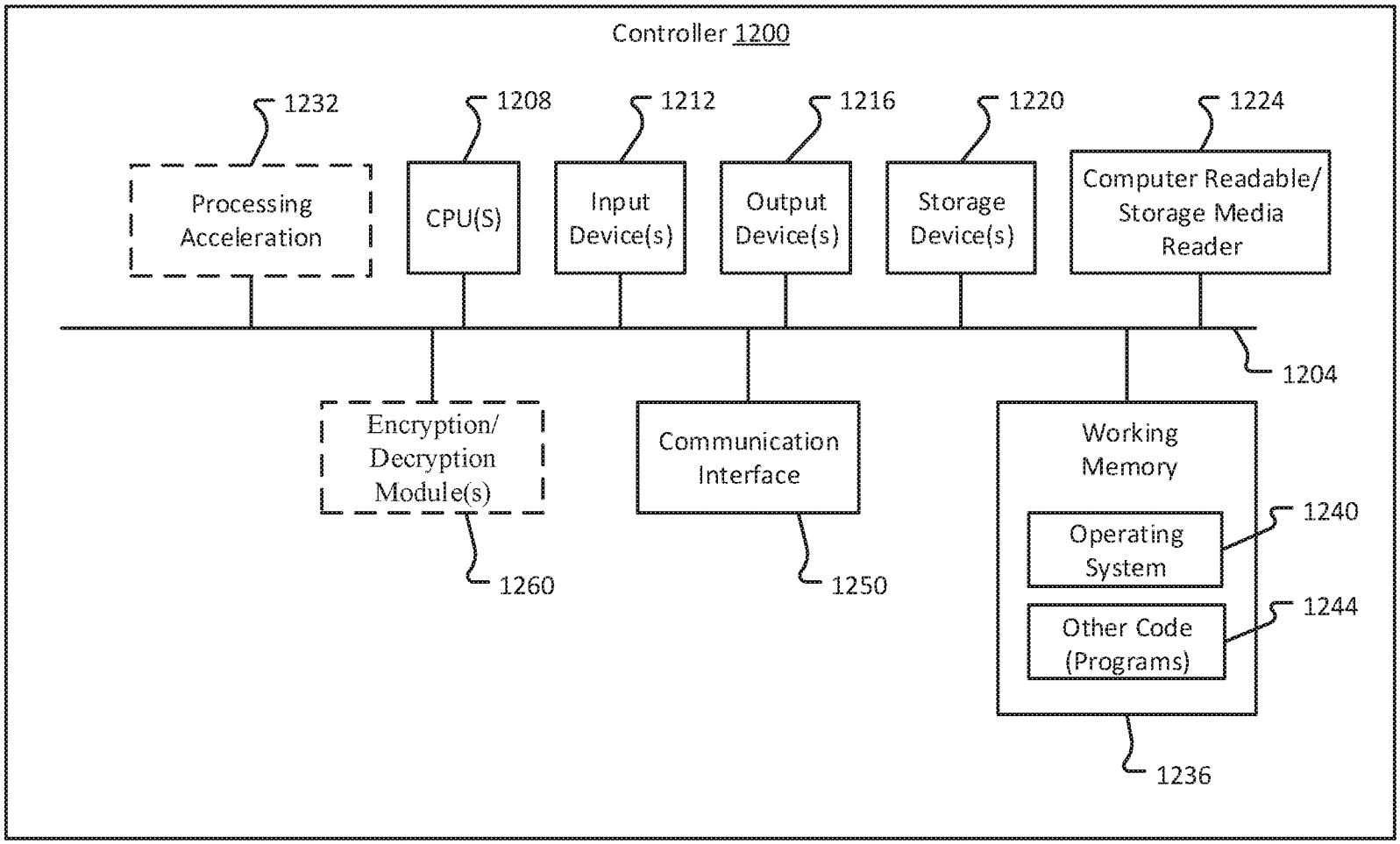
FIG. 12 is a block diagram of a controller associated with one or more components described herein.

The controller 120 is configured to implement the processes used by the electronic device 100. The controller 120 is the same or similar to controller 1000, as shown in FIG. 12. The controller 120 interfaces with the transceiver 130 to transmit and receive message over a wireless link, and to use input from the optional sensor(s) 190. The controller 120 may also interface with the device or appliance that the electronic device is contained in. For example, the controller 120 may interface with the controller for a microwave oven to allow information concerning the operation and status of the microwave oven to be transmitted to an endpoint device, such as a smartphone.

Figure 2A:
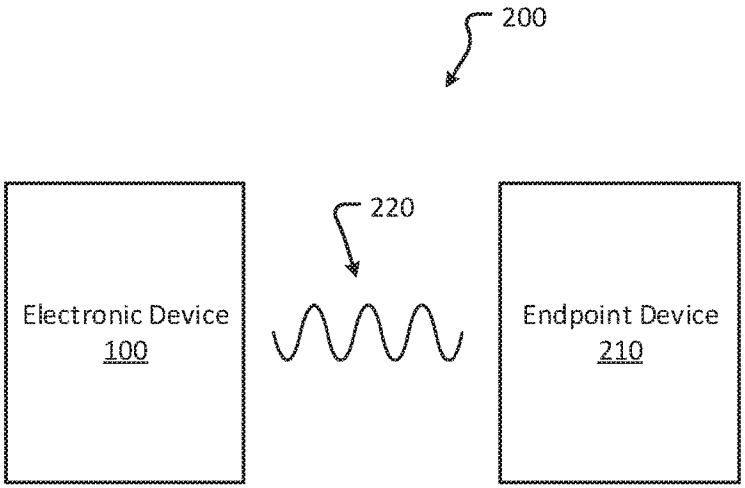
FIG. 2A is a block diagram of a wireless communication system illustrating direct communication between an electronic device and an endpoint device via a wireless communication signal in accordance with at least one embodiment of the present disclosure.
Figure 2B:
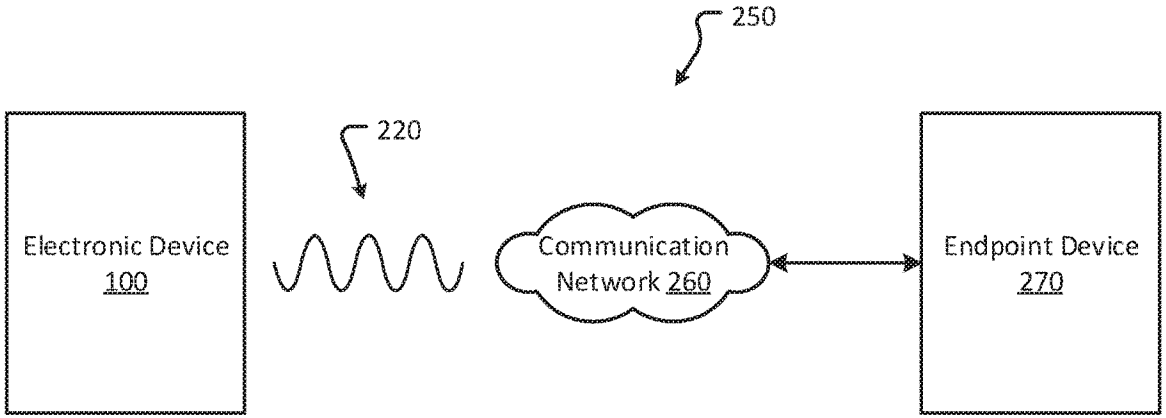
FIG. 2B is a block diagram of a wireless communication system illustrating indirect communication between an electronic device and an endpoint device via a wireless communication signal and a communication network in accordance with at least one embodiment of the present disclosure.

The transceiver 130, a radio circuit, produces the radio frequency (RF) signal transmitted by the antenna system and receives RF signals from the antenna system, which comprises the feed block 150, the gap 160, the antenna coupler 170, and the label antenna 180. The controller 120 and/or transceiver 130 implement the wireless protocols used to communicate with endpoint devices, as shown in FIGS. 2A and 2B. The transceiver 130 may comprise an amplifier circuit to amplify the RF signal before transferring the RF signal to the matching network 140.

The matching network 140 comprises a resonant circuit and may consist of multiple inductances and capacitances that are in parallel, series, or any combination thereof. Additionally, inductances may include a core material that may consist of air, ferrite, steel, alloy, powdered metal, and/or other core material—including combinations thereof. Also, capacitances may include dielectric material that may consist of air, glass, paper, mica, and/or other dielectric material. Inductances and capacitances may include parasitic inductance and parasitic capacitance, and/or inductors and capacitors. Configuration of the matching network 140 may need to include the capacitance of the coupling between the feed block 150 and antenna coupler 170. The matching network 140 is configured to match the output impedance of transceiver to the input impedance of the antenna system that comprises the feed block 150, the gap 160, the antenna coupler 170, and the label antenna 180 to maximize the power transfer and/or minimize signal reflection from the antenna system.

Configuration of the electronic device 100 may need to include the desired center frequency and bandwidth of the desired wireless technology used for communication (e.g., Wi-Fi, Bluetooth® LE, ZigBee, and/or the like). The size and configuration of the matching network 140, feed block 150, gap 160, antenna coupler 170, and label antenna 180 may be adjusted to a desired center frequency and bandwidth. Typically, the thickness of the label antenna is 40 μm but may vary based on cost, rigidity of the label, antenna performance, and/or other factors.

The gap 160 is between the feed block 150 and the antenna coupler 170, where the gap 160 is a separation distance between the feed block 150 and the antenna coupler 170. When the transceiver 130 is transmitting, the feed block 150 induces electrical currents on the antenna coupler 170 through gap 160. In this way, the feed block 150 and the antenna coupler 170 are capacitively coupled. The gap 160 may comprise at least one or more dielectrics (e.g., air, glass, paper, mica, and/or other dielectric material). The capacitance of the coupling is inversely proportional to the distance between and proportional to the area of the surfaces of the feed block 150 and of the antenna coupler 170. Configuration of the matching network 140 may need to include the capacitance of the coupling to improve the bandwidth and antenna radiation pattern of the electronic device 100.

Conversely, when the electronic device 100 is receiving a signal, the antenna coupler 170 induces electrical currents on the feed block 150 through the gap 160. The transceiver 130 may convert the received signals to data that is provided to the controller 170.

Figure 3A:
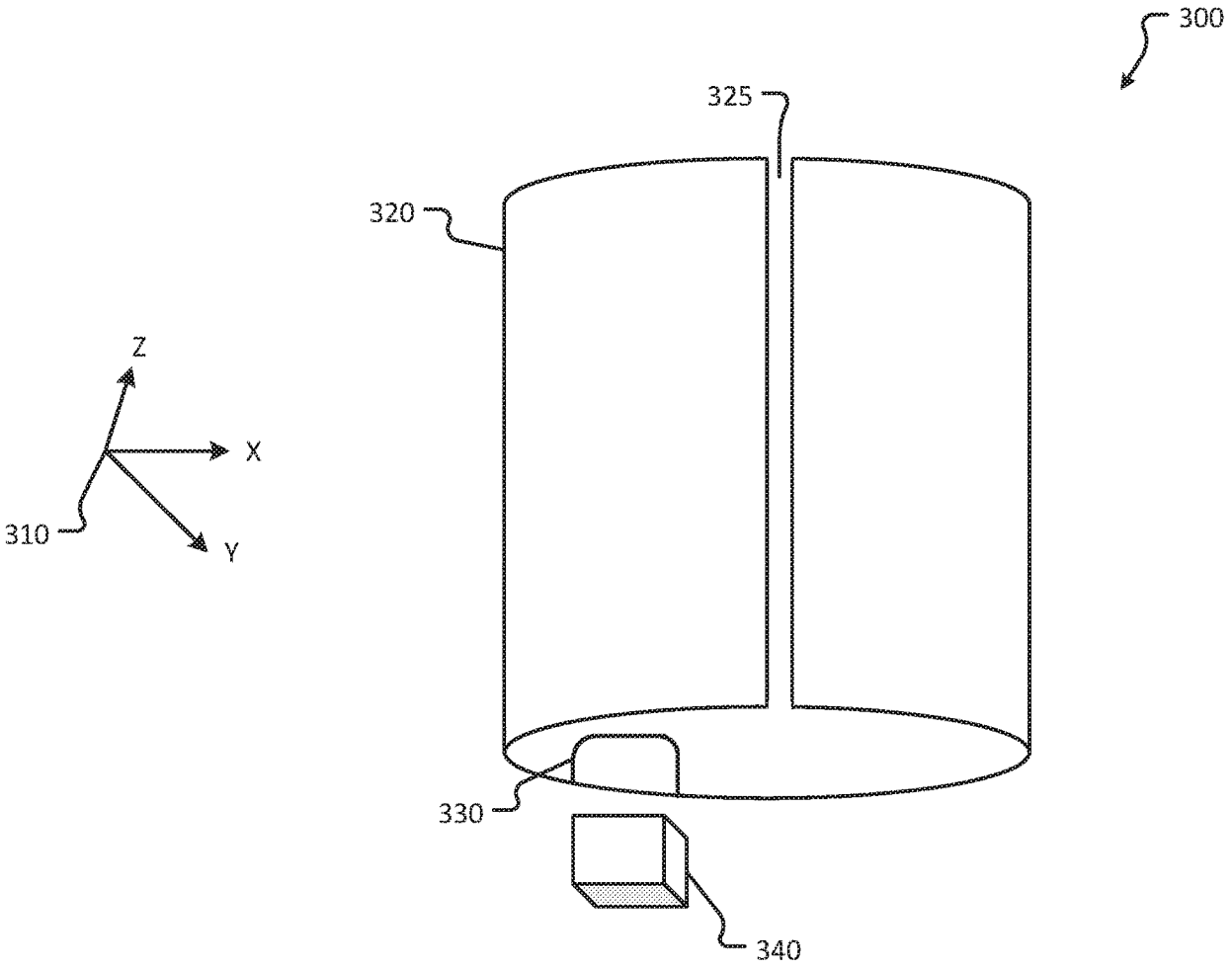
FIG. 3A shows an embodiment of a label antenna, an antenna coupler, and a feed block according to one embodiment of the present disclosure.
Figure 3B:
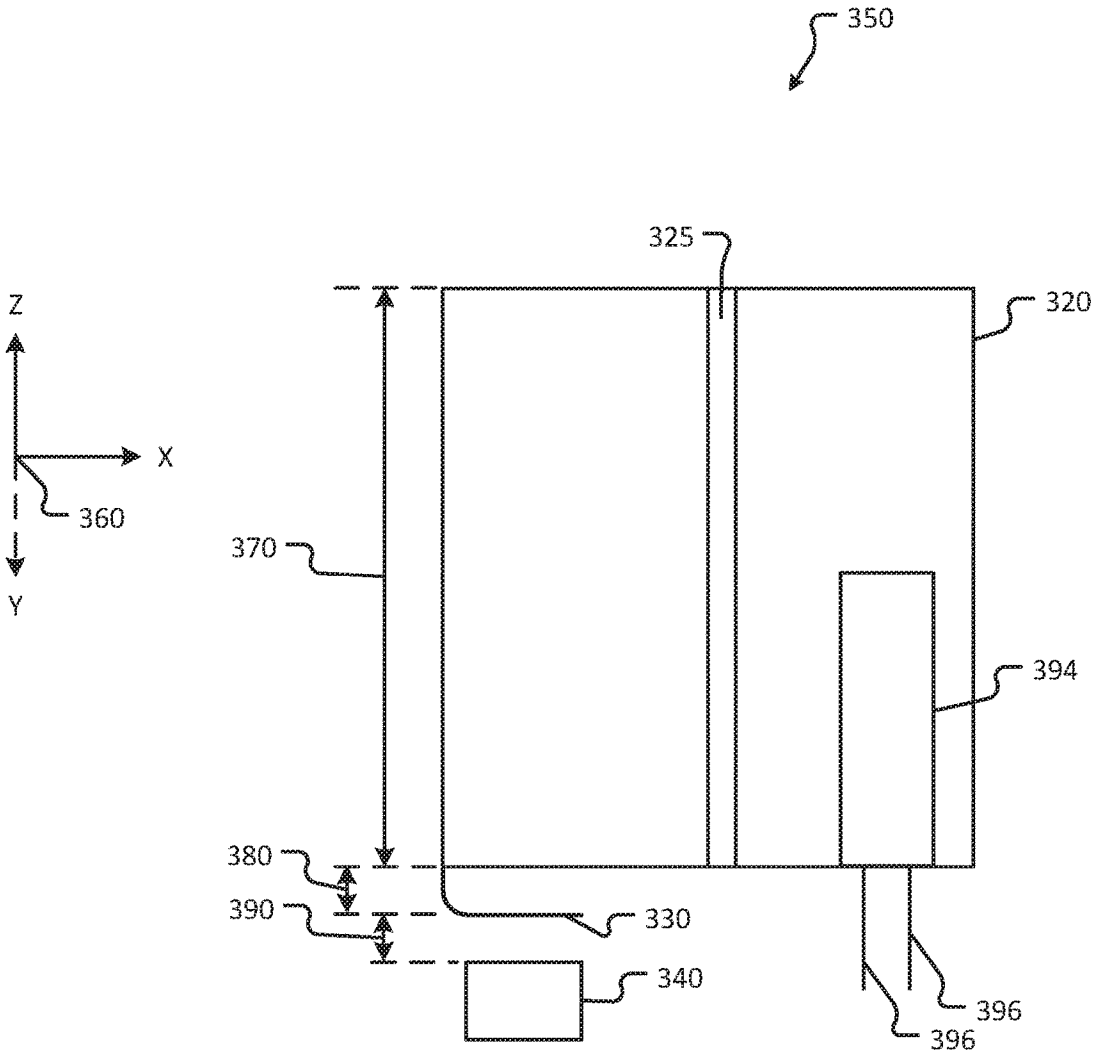
FIG. 3B shows an embodiment of a label antenna, an antenna coupler, and a feed block with a different orientation than the previous embodiment according to one embodiment of the present disclosure.
Figure 6:
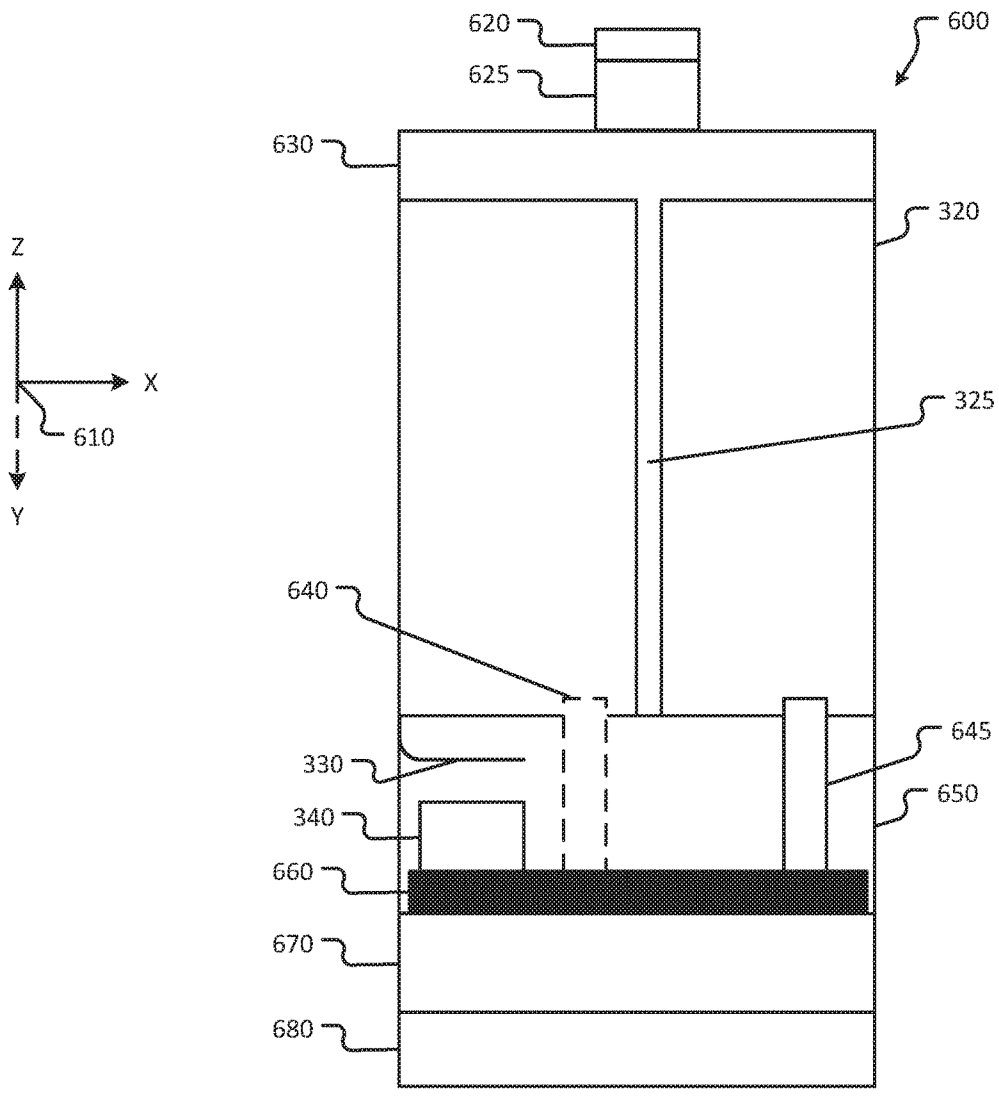
FIG. 6 shows an embodiment of a system comprising a container and components of an electronic device in accordance with at least one embodiment of the present disclosure.

The induced electrical currents are transferred to the label antenna 180 that radiates a radio frequency (RF) signal. The antenna radiation pattern of the label antenna 180 is omni-directional when the label antenna 180 is formed into a non-closed cylinder, as shown in FIGS. 3A, 3B, and 6. In other antenna configurations, the antenna radiation pattern of the label antenna 180 may be a directional radiation pattern. In some embodiments, the antenna label is adhesively attached to a shipping box and is configured to lie flat, as shown in FIG. 7. For these embodiments, the antenna radiation pattern is directional rather than omni-directional.

The label antenna 180 comprises at least a conductive layer consisting of aluminum (Al), silver (Ag), gold (Au), copper (Cu), nickel (Ni), palladium (Pd), platinum (Pt), alloys, composites, and mixtures thereof. When the label antenna 180 is attached to a container, the surface facing the container may comprise an adhesive layer to attach the label antenna 180 to the container, as shown in FIGS. 6 and 7. Alternatively, the label antenna 180 may wrap around the container without the use of an adhesive. When the surface of the container is a conductor, the adhesive layer may perform the function of a dielectric or insulator to separate the conductive layer of the label antenna 180 and the conductive surface of the container. In some embodiments, a dielectric or insulator layer is inserted between the conductive layer of the antenna label 180 and the adhesive. The surface of the label antenna 180 facing away from the container may contain printing typically found on a label, such as a description of the contents of the container. A dielectric or insulator layer may be applied to the surface of the label antenna 180 facing away from the container before and/or after printing. If the label antenna 180 comprises an aluminum conductive label, then aluminum oxide may be used as the dielectric or insulator layer. In some embodiments, the electronic device 100 may be attached to or formed on wearable fabrics to create wearable electronics.

Figure 11:
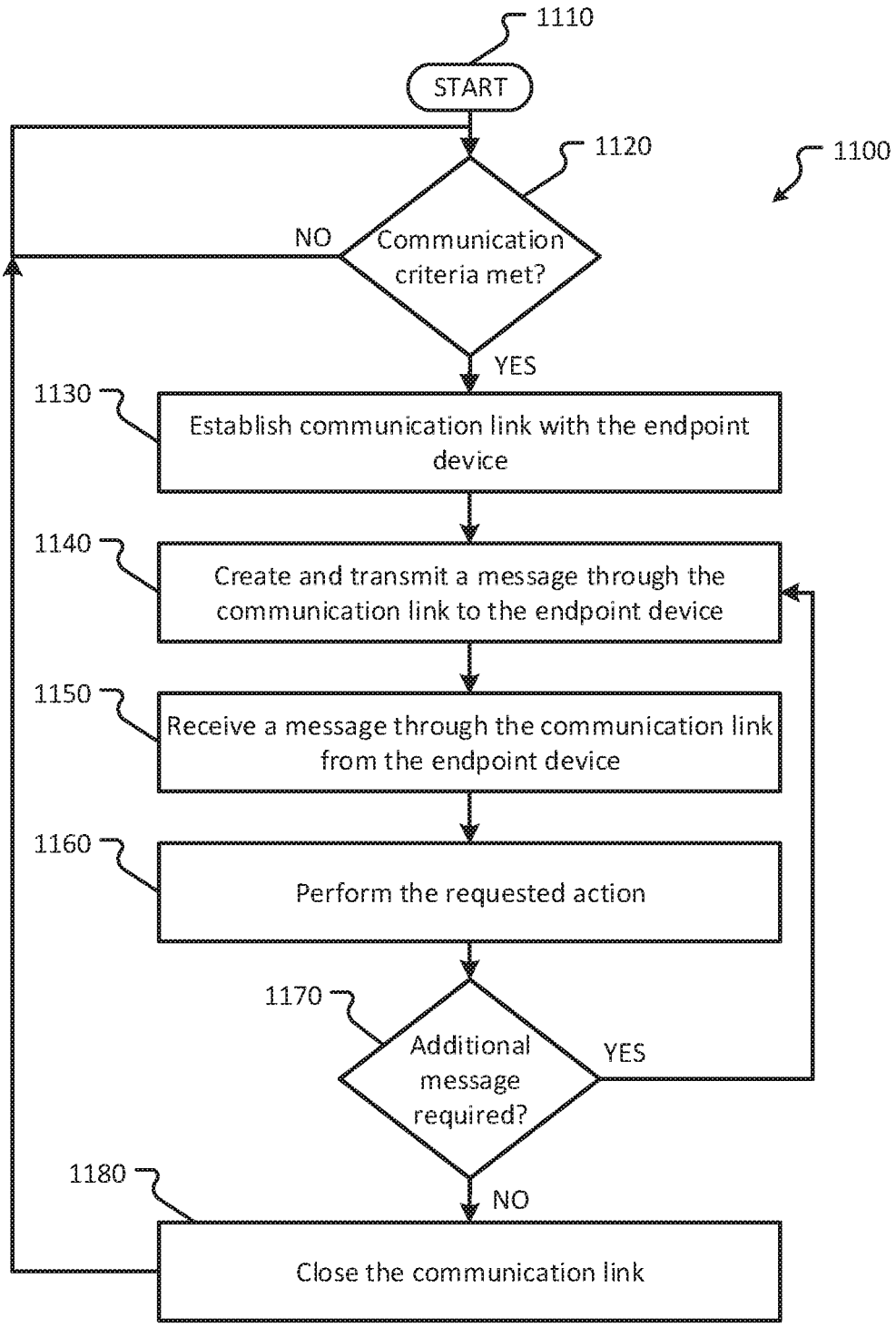
FIG. 11 is a flowchart illustrating one process that may be performed by an electronic device when communicating with an endpoint device in accordance with at least one embodiment of the present disclosure.

The optional sensor(s) 190 may comprise one or more acoustic, flow, force, pressure, position, optical, presence and/or other type of sensor. Information from the optional sensor(s) 190 may be used in determining whether the communication criteria has been met, as shown in FIG. 11. In one embodiment, a pressure sensor may be used to determine if a patient is using a medicine container. Alternatively, or additionally, a pressure sensor may be placed at the bottom of the medicine container and used to determine whether a prescription renewal is needed based on the weight of the medicine container and contents.

FIG. 2A is a block diagram of a wireless communication system 200 illustrating direct communication between an electronic device 100 and an endpoint device 210 via a wireless communication signal 220. The electronic device 100 is described in FIG. 1. The wireless communication signal 220 is radio frequency (RF) transmissions radiated from the label antenna and includes information from the controller 120 and encapsulated by the transceiver 130 to convey the information over technologies such as Wi-Fi, Bluetooth® LE, ZigBee, GSM, LTE, and/or the like.

The endpoint device 210 can be or may include any communication device that can communicate via the wireless communication signal 220 and/or via the communication network 260, such as a computer server, cloud services, Personal Computer (PC), a cellular telephone, a Personal Digital Assistant (PDA), a tablet device, a notebook device, a smartphone, and the like. The endpoint device 210 responds to messages sent by the controller 120 in response to communication criteria. Alternatively, or additionally, the endpoint device 210 may initiate communication. To communicate with electronic device 100, the endpoint device 210 must implement the same protocols and technologies to receive and process the wireless communication signal 220.

FIG. 2B is a block diagram of a wireless communication system 250 illustrating indirect communication between an electronic device 100 and an endpoint device 270 via a wireless communication signal 220 and a communication network 260. In this example embodiment, the endpoint device 270 is the same or similar to endpoint device 210, but must implement protocols and communication technologies to exchange information directly with the communication network 260. The link between communication network 260 and endpoint device 270 may use wireless or wired communication technologies.

The communication network 260 can be or may include any collection of communication hardware and software that can send and receive electronic communications, such as the Internet, a Wide Area Network (WAN), a Local Area Network (LAN), a Voice over IP Network (VoIP), the Public Switched Telephone Network (PSTN), a packet switched network, a circuit switched network, a cellular network, a combination of these, and the like. The communication network 260 can use a variety of electronic protocols, such as Ethernet, Internet Protocol (IP), Session Initiation Protocol (SIP), Integrated Services Digital Network (ISDN), Hyper Text Markup Language (HTML), Java Script, Web Real-Time Communication (WebRTC), and/or the like. Messages transmitted over a communication network 260 may use technologies such as Wi-Fi, Bluetooth®, ZigBee, GSM, LTE, Ethernet, or any other wired or wireless communication protocol. The communication network 260 must comprise at least a wireless communication link to exchange data with electronic device 100. The communication link with the endpoint device 270 may use the same technology, or another technology, including a wired communication link.

FIG. 3A shows an embodiment 300 of a label antenna 320, an antenna coupler 330, and a feed block 340. The label antenna 320 is one embodiment of the label antenna 180, the antenna coupler 330 is an embodiment of the antenna coupler 170, and the feed block 340 is an embodiment of the feed block 150. The axes 310 shows the X axis in the horizontal direction, the Y axis in a tilted horizontal direction, and the Z axis in a tilted vertical direction perpendicular to the X-Y plane. The label antenna 320 is formed into an open cylinder where two ends of the cylinder form a gap 325 along the Z axis. The antenna coupler 330 is electrically coupled to the label antenna 320. The feed block 340 is positioned below the antenna coupler 330 with similar X-Y coordinates but displaced along the Z axis.

FIG. 3B shows an embodiment 350 of a label antenna 320, an antenna coupler 330, and a feed block 340 with a different orientation than the previous embodiment 300. The embodiment 300 and embodiment 350 are the same embodiments, but oriented in a different angle to show sizes and distances between components. The axes 360 shows that the X axis in a horizontal direction, the Y axis perpendicular with the plane of the X-Z plane, and the Z axis in a vertical direction. The label antenna 320 is formed into an open cylinder where two ends of the cylinder form a gap 325 along the Z axis. The antenna coupler 330 is electrically coupled to the label antenna 320. The feed block 340 is positioned below the antenna coupler 330 with similar X-Y coordinates but displaced along the Z axis. Embodiment 350 includes a sensor 394, not shown in FIG. 3A, that comprises two leads 396.

The distance 370 is the height of the label antenna along the Z axis. The distance 380 is the distance between the antenna coupler 330 and the feed block 340. As shown in this embodiment, the antenna coupler 330 is oriented into the interior of the cylinder formed by the label antenna 320. In other embodiments, the antenna coupler 330 is oriented toward the exterior of the cylinder formed by the label antenna 320. In the example embodiment, the gap 325 is approximately 1 mm, the distance 370 is approximately 31.5 mm, and the distance 380 is approximately 1.2 mm, and the length of the antenna label is approximately 70 mm, but these distances may vary based on antenna performance, desired capacitive coupling, dimensions of the container and/or other factors. Typically, the dimensions of the antenna coupler 330 and top surface of the feed block 340 are similar. For example, the antenna coupler 330 may be a tab that is 3 mm wide by 3.55 mm long, and the feed block 340 may be a liquid crystal polymer with metal plating having dimensions 3 mm wide, by 3 mm wide, by 2.4 mm high.

The distance 390 is the gap 160, as shown in FIG. 1. The capacitance of the coupling is inversely proportional to the distance between and proportional to the area of the surfaces of the feed block 340 and of the antenna coupler 330. The capacitance of the coupling may also be increased by filling some or all of the gap 160 with a material with a relative permittivity greater than one (e.g., paper, glass, mica, and/or the like). Typically, the distance 390 is approximately 1.7 mm but may vary based on antenna performance, desired capacitive coupling, and/or other factors.

Sensor 394 is an example of an optional sensor(s) 190, as shown in FIG. 1. In one embodiment, sensor 394 is a pressure sensor that may be used to determine if a patient is using a medicine container by detecting pressure on the side of the container. Sensor 394 may be between the label antenna 320 and the container or on the outer surface of label antenna 320. The two leads 396 of the sensor 394 may be electrically coupled to the controller 120 to convey sensor data. Sensor data may be used in determining whether the communication criteria has been met in process 1100, as shown in FIG. 11.

Figure 4:
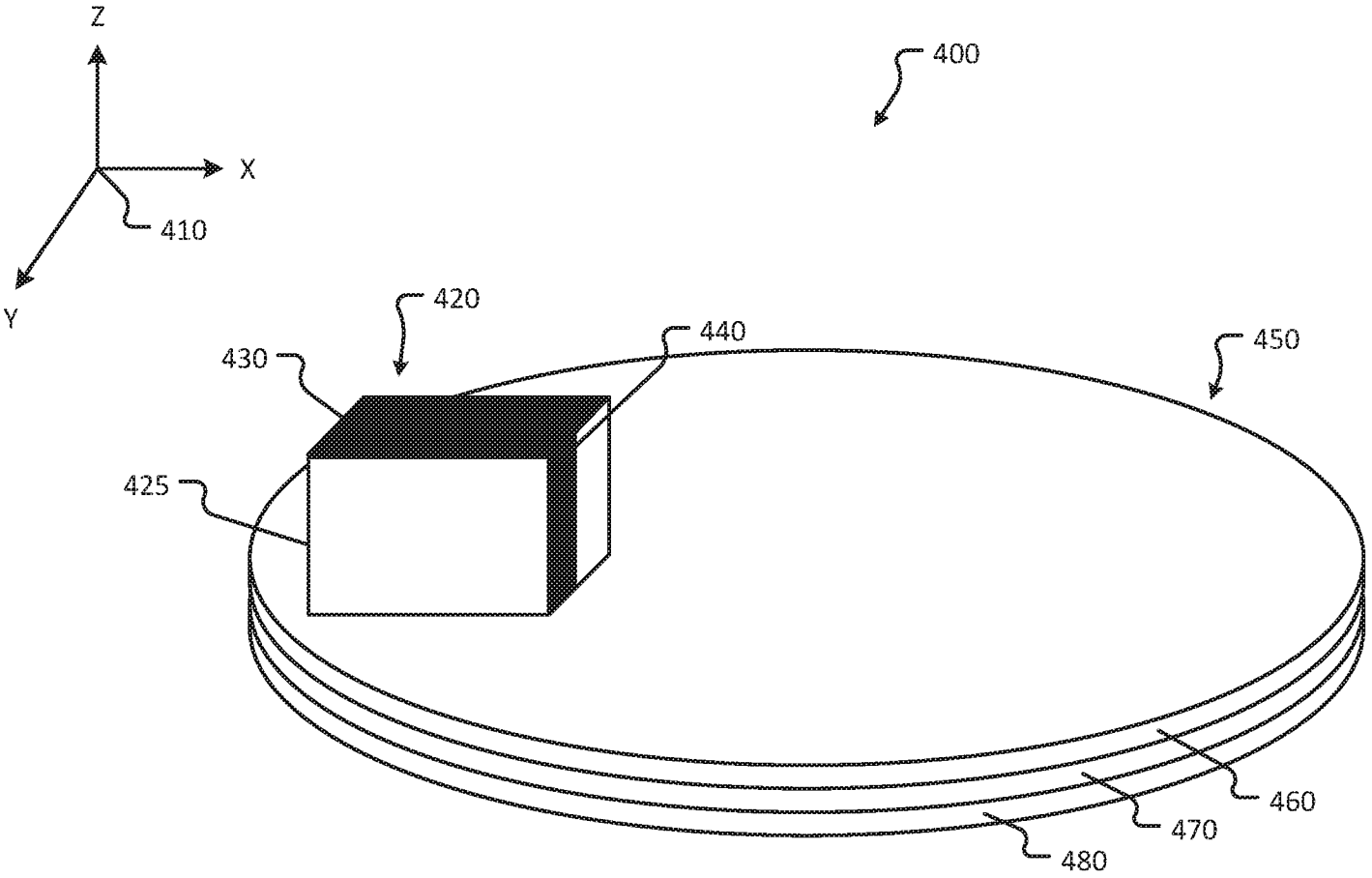
FIG. 4 shows an embodiment of a feed block on a circuit board according to one embodiment of the current disclosure.

FIG. 4 shows an embodiment 400 of a feed block 420 on a circuit board 450. The axes 410 shows that the X axis in a horizontal direction, the Y axis tilted forward, and the Z axis perpendicular to the X-Y plane. The feed block 420 is an embodiment of the feed block 150, and is similar to or the same as the feed block 340. The diameter of the circuit board 450 may vary based on the size of the container, size and number of components, desired size of the ground plane, and/or other factors. For example, the diameter of the circuit board 450 may be 20 mm for a medicine container.

In this example embodiment, the feed block 420 comprises a dielectric block 425, typically a plastic polymer, a metal patch 430, and a feed line 440. The metal patch 430 capacitively couples with the antenna coupler 330, as shown in FIGS. 3A and 3B. The feed line 440 electrically couples the matching network 140, as shown in FIG. 1, to the metal patch 430.

The circuit board 450 consists of three layers, a ground plane 460, a dielectric layer 470, and a trace layer 480. Other embodiments may include one or more ground planes, and/or one or more trace layers. The ground plane 460 provides a ground plane for the antenna system and provides a ground for the components on the circuit board. The feed block 420 may be mounted to the circuit board 450 using through-hole vias, soldering pads, and/or other mounting technology. The ground plane 460 may include the area or traces under the feed block 420.

In some embodiments, the feed block 420 may be a molded interconnect device (MID) comprising a thermoplastic carrier in which conductive metal surfaces are integrated on the surface of the thermoplastic carrier. Laser directed structuring (LDS) may be used to etch the dielectric block surface, exposing the LDS catalyst and creating a structure to provide a foundation for adhesion of metal to the dielectric block 425. Selective plating processes, such as electroless or electrolytic plating, may be used to deposit metal onto the lasered surface to create the metal patch 430 and the feed line 440. The deposited metal may be aluminum (Al), silver (Ag), gold (Au), copper (Cu), nickel (Ni), palladium (Pd), platinum (Pt), alloys, composites, and mixtures thereof. Electroless plating includes using electroless plating solutions to plate different metals (e.g., a single layer or multilayer, electroless copper, electroless nickel immersion gold, electroless silver, immersion tin).

Figure 5:
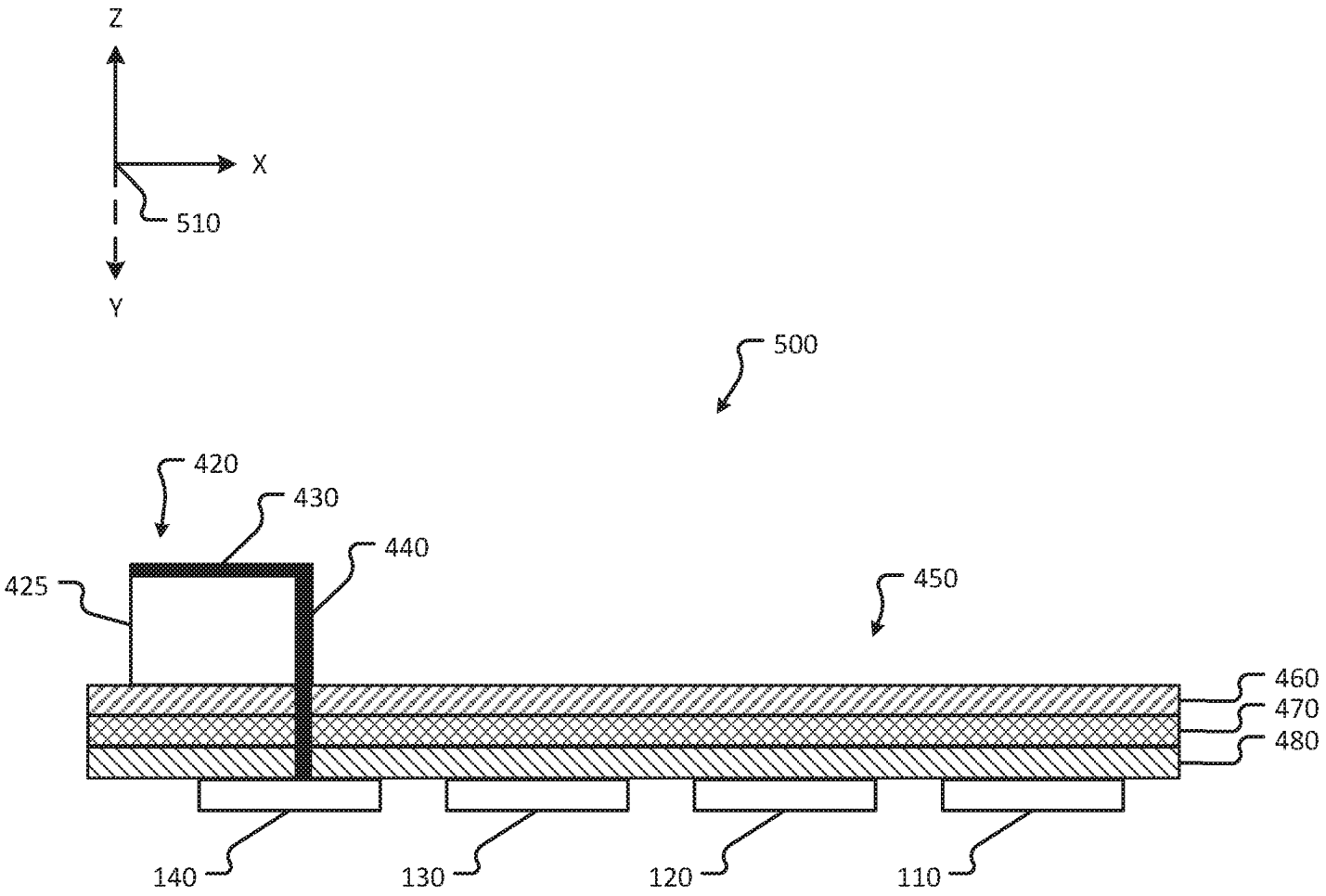
FIG. 5 shows an embodiment of a feed block on a circuit board according to one embodiment of the current disclosure.

FIG. 5 shows an embodiment 500 of a feed block 420 on a circuit board 450. The feed block 420 and the circuit board 450 are the same as shown in FIG. 4 but oriented to show a side view of embodiment 500. The axes 510 shows that the X axis in a horizontal direction, the Y axis perpendicular to the X-Z plane, and the Z axis in a vertical direction. As described previously, the feed block 420 is mounted on circuit board 450. The metal patch 430 of the dielectric block 425 capacitively couples with the antenna coupler 330, as shown in FIGS. 3A and 3B.

The feed line 440 electrically connects the metal patch 430 through the circuit board 450 to the matching network 140, also shown in FIG. 1. Also shown in FIG. 1, the power source 110, the controller 120, and the transceiver 130 connect to other components of the electronic device 100 via traces on the trace layer 480. In some embodiments, one or more of the components of the electronic device 100 are mounted to a second circuit board, not shown. Alternatively, the power source 110 may be one or more batteries or battery cells held in a battery compartment with conductors to connect the battery to the circuit board 450.

FIG. 6 shows an embodiment of a system 600 comprising a container and components of an electronic device 100. The axes 610 shows that the X axis in a horizontal direction, the Y axis perpendicular to the X-Z plane, and the Z axis in a vertical direction. The container comprises a cap 620, a neck 625, and a body 630. The body 630 may contain a fluid, tablets, or other substances that pass through the neck 625 when the cap 620 is removed. In some embodiments, the container may comprise a low-density polyethylene (LDPE) that is widely used for manufacturing various containers, wash bottles, dispensing bottles, tubing, and plastic parts for computer components.

The antenna label 320 wraps around the body 630 leaving a gap 325. The antenna label 320 is electrically connected to the antenna coupler 330, described in FIGS. 3A and 3B. The feed block 340 is mounted on the circuit board 660, the same or similar to circuit board 450 as shown in FIGS. 4 and 5. The compartment 650 may contain the antenna coupler 330, the feed block 340, and the circuit board 660. The compartment 670 may contain the other components of the electronic device 100. Finally, the compartment 680 may contain the power source 140, as described in FIG. 1. Compartments 650, 670, and 680 may comprise a stand for the container.

The system 600 may optionally include direct coupling portions 640 and 645 that connect to the ground plane of circuit board 660 to improve antenna matching and radiation characteristics. The direct coupling portions 640 and 645 may be conductive tabs 6 mm wide and 6 mm long, but may vary based on antenna performance, dimensions of the container, and/or other factors. In some embodiments, the direct coupling portion 640 and 645 may also serve as a sensor. Alternatively, or additionally, one or more sensor(s) 190 may be used, as described in FIGS. 1 and 3B.

Figure 7B:
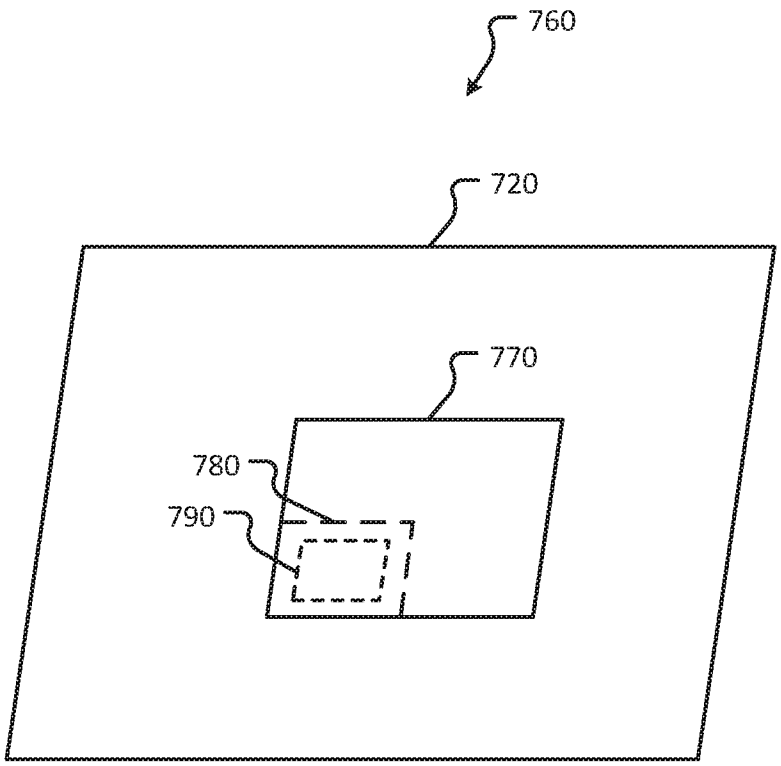
FIG. 7B shows another embodiment of a container, a label antenna, an antenna coupler, and a feed block according to one embodiment of the present disclosure.
Figure 7A:
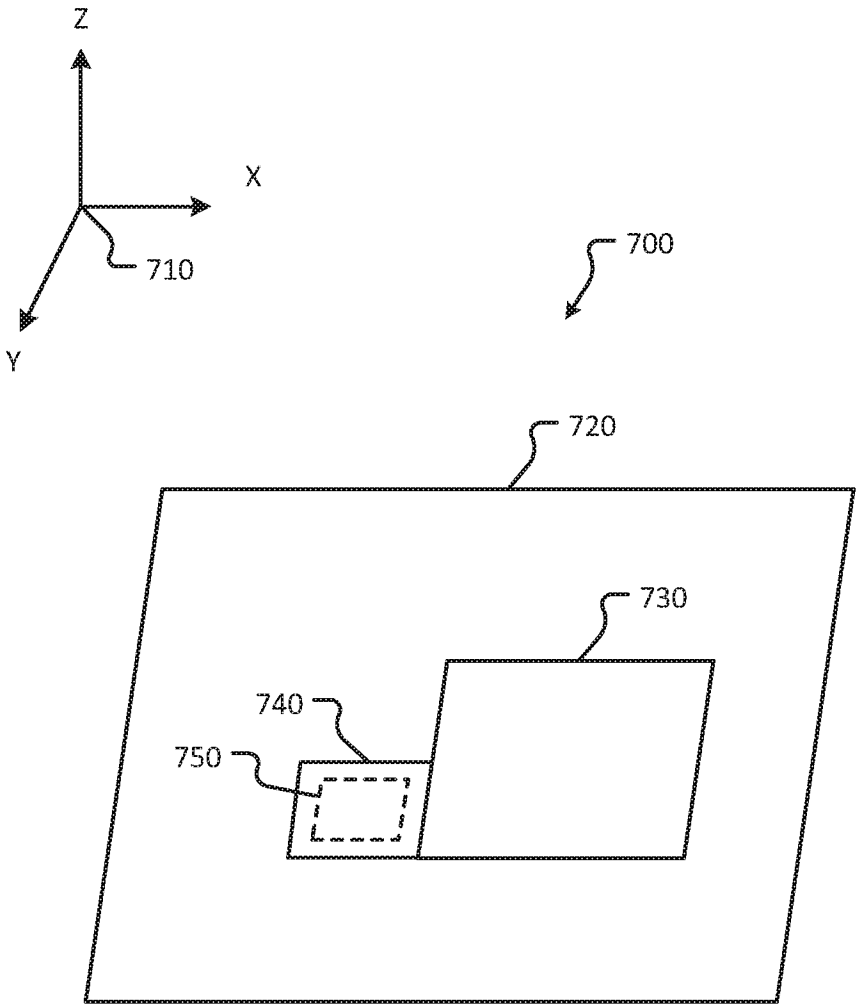
FIG. 7A shows one embodiment of a container, a label antenna, an antenna coupler, and a feed block according to one embodiment of the present disclosure.

FIG. 7A shows one embodiment 700 of a container 720, a label antenna 730, an antenna coupler 740, and a feed block 750. The label antenna 730 and antenna coupler 740 may be attached to the container 720 using an adhesive. The antenna coupler 740 is electrically coupled to the antenna label 730 is aligned over the feed block 750 with a z-displacement equivalent to the gap 160, as shown in FIG. 1. The gap 160 between the antenna coupler 740 and feed block 750 may be at least equivalent to the thickness of the container 720.

When container 720 comprises a conductor that partially or wholly fills the gap between the antenna coupler 740 and the feed block 750, then a hole must by formed to allow the antenna coupler 740 and feed block 750 to convey electrical signals. The hole may be filled by one or more dielectric materials (e.g., air, glass, paper, mica, and/or other dielectric material). Additionally, the label antenna 730 may comprise a dielectric or insulator layer to separate the conductive layer of the label antenna 730 from the conductive surface of the container 720. In some embodiments, the adhesive attaching the label antenna 730 and antenna coupler 740 is the dielectric or insulator layer.

FIG. 7B shows another embodiment 760 of a container 720, a label antenna 770, an antenna coupler 780, and a feed block 790. The label antenna 770 and antenna coupler 780 may be attached to the container 720 using an adhesive. The antenna coupler 780 is electrically coupled to the antenna label 770 is aligned over the feed block 790 with a z-displacement equivalent to the gap 160, as shown in FIG. 1. The gap 160 between the antenna coupler 780 and feed block 790 may be at least equivalent to the thickness of the container 720. A portion of the label antenna 770 overlaps the antenna coupler 780. Similarly, a portion of the antenna coupler 780 overlaps the feed block 790.

When container 720 comprises a conductor that partially or wholly fills the gap between the antenna coupler 780 and the feed block 790, then a hole must by formed to allow the antenna coupler 780 and feed block 790 to convey electrical signals. The hole may be filled by one or more dielectric materials (e.g., air, glass, paper, mica, and/or other dielectric material). Additionally, the label antenna 770 may comprise a dielectric or insulator layer to separate the conductive layer of the label antenna 770 from the conductive surface of the container 720. In some embodiments, the adhesive attaching the label antenna 770 and antenna coupler 780 is the dielectric or insulator layer.

Figure 8:
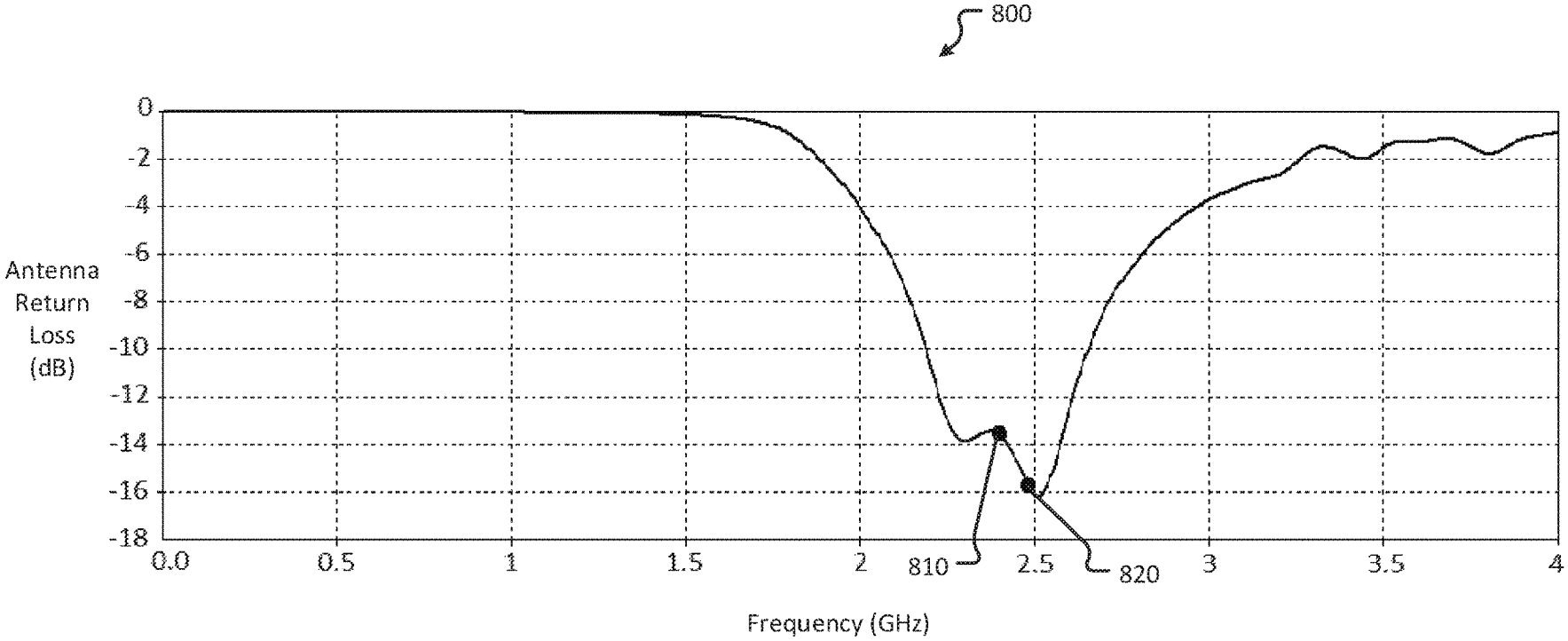
FIG. 8 shows a graph of antenna return loss as a function of frequency when using a matching network in accordance with at least one embodiment of the present disclosure.

FIG. 8 shows a graph 800 of antenna return loss as a function of frequency when using a matching network. The matching network comprises a 5.46 nH inductor, a 1 pF shunt capacitor, and two grounded tabs, as shown in FIG. 6. The matching network is similar to or the same as matching network 140, and the antenna used to generate the graph 800 is similar to or the same as label antenna 320. Marker 810 of graph 800 is an antenna return loss of −13.588 dB at 2.4 GHz, and marker 820 is an antenna return loss of −15.782 dB at 2.483 GHz.

Figure 9:
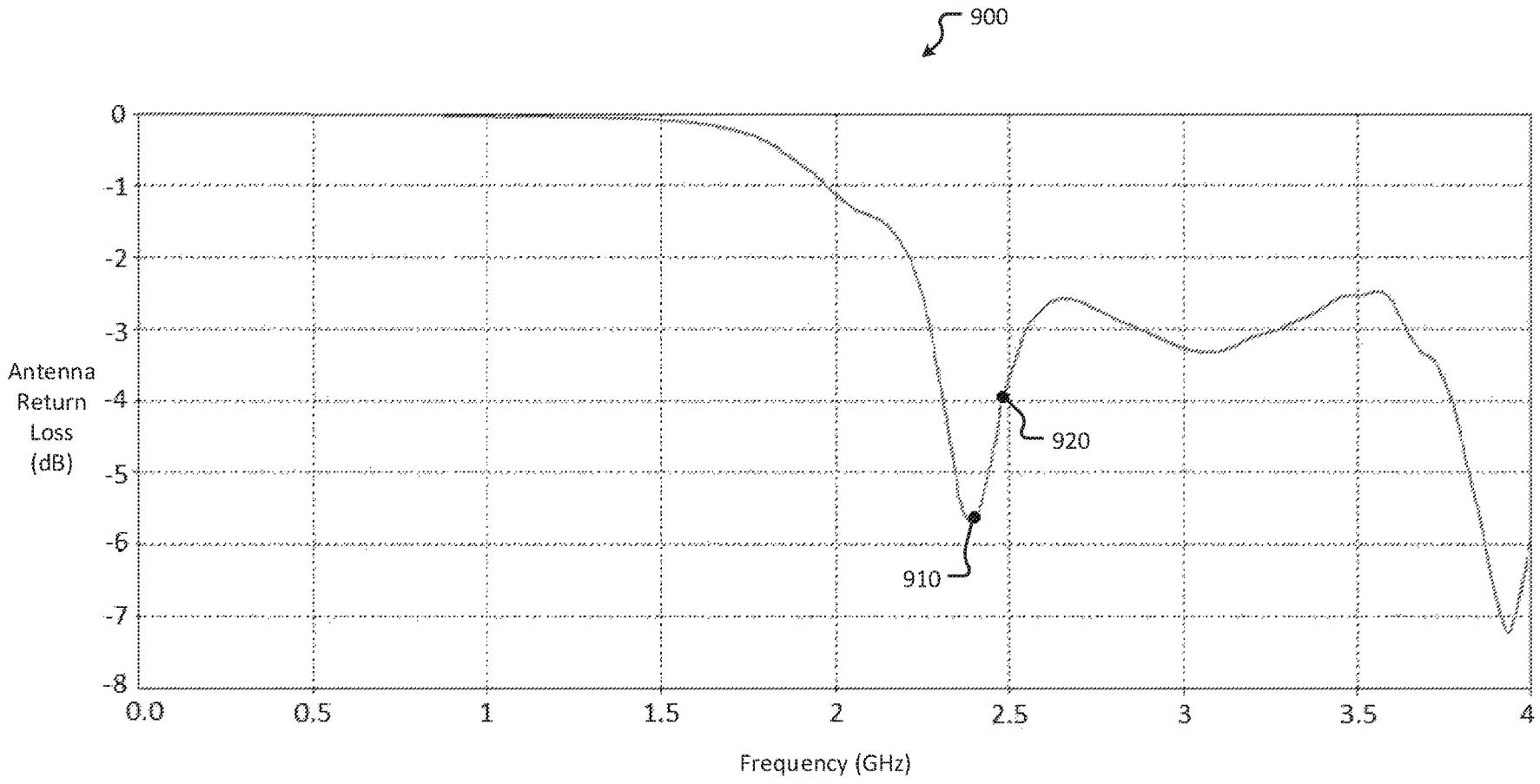
FIG. 9 shows a graph of antenna return loss as a function of frequency when not using a matching network in accordance to one embodiment of the current disclosure.

FIG. 9 illustrates a graph 900 of antenna return loss as a function of frequency when not using a matching network. For this example embodiment, the transceiver 130 may be directly connected to the feed block 150. The antenna used to generate the graph 900 is similar to or the same as label antenna 320. Marker 910 of graph 900 is an antenna return loss of −5.6492 dB at 2.4 GHz, and marker 920 is an antenna return loss of −3.9758 dB at 2.483 GHz. As can be seen when comparing graph 800 and graph 900, the matching network improves the bandwidth and reduces the antenna return loss.

Figure 10:
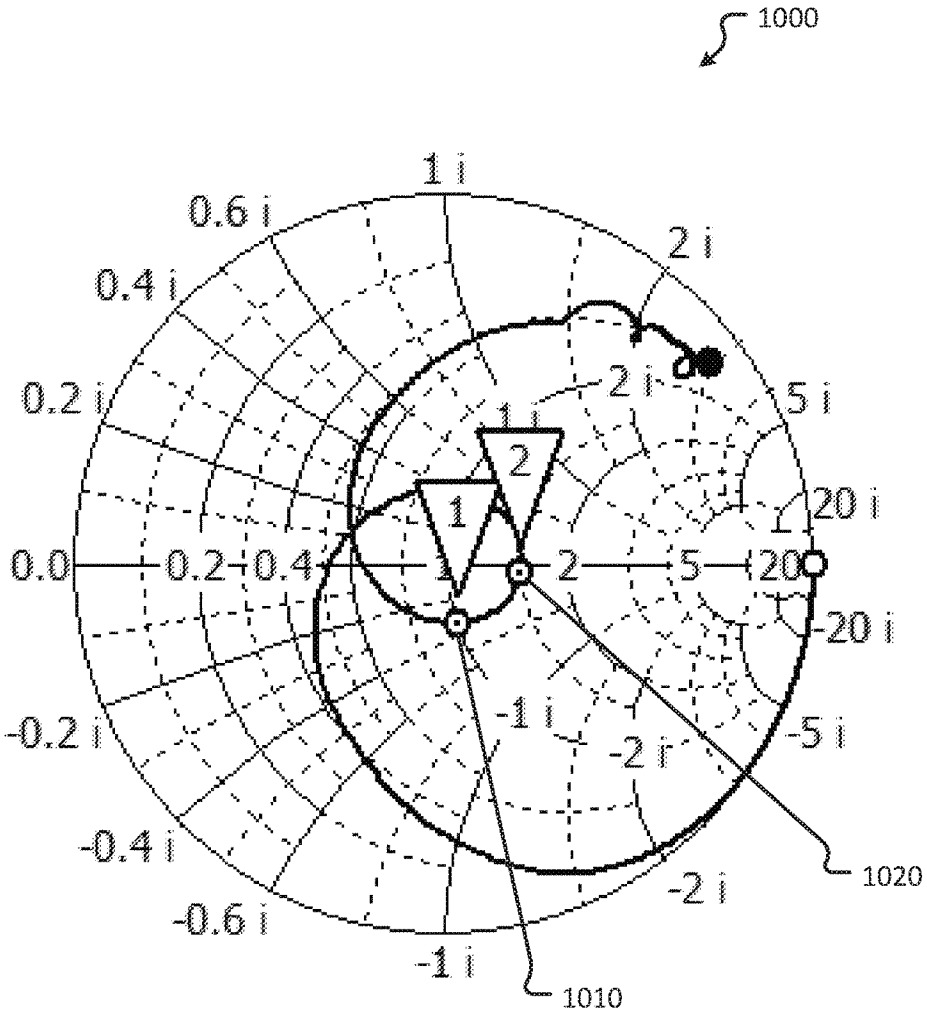
FIG. 10 illustrates a Smith Chart of antenna impedance of a label antenna as a function of frequency in accordance with at least one embodiment of the present disclosure.

FIG. 10 illustrates a Smith Chart 1000 of antenna impedance of a label antenna 320 as a function of frequency. The Smith Chart displays the complex reflection coefficient, or impedance, determined by the impedance of the label antenna 320 and the transmitter impedance of 50 ohm as a function of frequency. The locus of impedances include impedance 1010 that corresponds to a frequency of 2.483 GHz with an impedance of 51.649-16.651j ohm resulting in a Voltage Standing Wave Ratio (VSWR) of approximately 1.39. The impedance 1020 corresponds to a frequency of 2.4 GHz with an impedance of 76.223-3.194j ohm resulting in a VSWR of approximately 1.53. Typically, a VSWR less than 2 is considered very good.

FIG. 11 is a flowchart illustrating one process 1100 that may be performed by an electronic device 100 when communicating with an endpoint device 210 and/or 270. The process 1100 begins at 1110 and transitions to test 1120. At test 1120, the electronic device 100 determines if the communication criteria are met. The one or more communication criteria include the timer period between communication sessions, and/or input from one or more sensors. If test 1120 is NO, then the process 1100 repeats test 1120 until the communication criteria are met. If test 1120 is YES, then the process 1100 transitions to step 1130, and the electronic device 100 established a communication link with the endpoint device 210/270. At step 1140, the electronic device 100 creates and transmits a message through the communication link to the endpoint device 210/270.

The communication link may be a direct connection between the electronic device 100 and the endpoint device 210, as shown in FIG. 2A. Alternatively, the communication link may be an indirect connection between the electronic device 100 and the endpoint device 270, as shown in FIG. 2B.

At step 1150, electronic device 100 waits and then receives a message through the communication link from the endpoint device 210/270. At step 1160, electronic device 100 performs the requested action. At test 1170, electronic device 100 determines if an additional message is required. If test 1170 is YES, then the process transitions to step 1140 and another message is created and transmitted through the communication link to the endpoint device 210/270. If test 1170 is NO, then the process 1100 transitions to step 1180. At step 1180, the communication link is closed, and process 1100 transitions to test 120 to determine if the communication criteria have been met.

In some embodiments, endpoint device 210/270 establishes the communication link and initiates an exchange of messages with the electronic device 100. For example, endpoint device 210/270 may periodically poll the electronic device 100 for a status. Alternatively, the endpoint device 210/270 and/or the electronic device 100 may initiate an exchange of messages after a predetermined time period.

As described above, one application is ordering a medication refill. In some embodiments, one or more sensors may detect that the quantity of medication in a medicine bottle is low. The electronic device 100 may transmit an order to refill the medication to the endpoint device 210/270 without requiring input from the patient. In some embodiments, electronic device 100 is a device participating in an Internet of Things (IoT) or Internet of Medical Things.

FIG. 12 is a block diagram of a controller 1200 associated with one or more components described herein. The controller 1200 is the same or similar to controller 120. Controller 1200 is shown comprising hardware elements that may be electrically coupled via a bus or network 1204. The hardware elements may include one or more central processing units (CPUs) 1208; one or more input devices 1212 (e.g., a mouse, a keyboard, etc.); and one or more output devices 1216 (e.g., a display device, a printer, etc.). Controller 1200 may also include one or more storage devices 1220. By way of example, storage device(s) 1220 may be disk drives, optical storage devices, solid-state storage devices such as a random access memory (RAM) and/or a read-only memory (ROM), which can be programmable, flash-updateable and/or the like.

Controller 1200 may additionally include a computer-readable storage media reader 1224; working memory 1236, which may include RAM and ROM devices as described above; a communication interface 1250 (e.g., a modem, a network card (wireless or wired), an infra-red communication device, etc.); and (optionally) an encryption/decryption module(s) 1260. Controller 1200 may also include a processing acceleration 1232, which can include a DSP, a special-purpose processor, and/or the like. Processing acceleration may perform the radio signal processing required for transceiver 130.

The computer-readable storage media reader 1224 can further be connected to a computer-readable storage medium, which computer-readable storage medium (as well as, in some embodiments, storage device(s) 1220) may represent remote, local, fixed, and/or removable storage devices and storage media for temporarily and/or more permanently containing computer-readable information. Moreover, as disclosed herein, the term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information.

The controller 1200 may also comprise software elements, shown as being currently located within a working memory 1236, including an operating system 1240 and/or other code 1244, including code to perform the process illustrated in FIG. 11. It should be appreciated that alternate embodiments of controller 1200 may have numerous variations from the embodiments described above. For example, customized hardware might also be used and/or particular elements might be implemented in hardware, software (including portable software, such as applets), or both. Further, connection to other computing devices such as network input/output devices may be employed.

Examples of the processor 1208 as described herein may include, but are not limited to, at least one of Qualcomm® Snapdragon® 800 and 801, Qualcomm® Snapdragon® 620 and 615 with 4G LTE Integration and 64-bit computing, Apple® A7 processor with 64-bit architecture, Apple® M7 motion coprocessors, Samsung® Exynos® series, the Intel® Core™ family of processors, the Intel® Xeon® family of processors, the Intel® Atom™ family of processors, the Intel Itanium® family of processors, Intel® Core® i5-4670K and i7-4770K 22 nm Haswell, Intel® Core® i5-3570K 22 nm Ivy Bridge, the AMD® FX™ family of processors, AMD® FX-4300, FX-6300, and FX-8350 32 nm Vishera, AMD® Kaveri processors, Texas Instruments® Jacinto C6000™ automotive infotainment processors, Texas Instruments® OMAP™ automotive-grade mobile processors, ARM® Cortex™-M processors, ARM® Cortex-A and ARM926EJ-S™ processors, other industry-equivalent processors, and may perform computational functions using any known or future-developed standard, instruction set, libraries, and/or architecture.

The communication interface 1250 may permit data to be exchanged with the communication network 260, transceiver 130, sensor(s) 190, another network, and/or any other computing device described above with respect to the computer environments described herein. Communication interface 1250 may support networking technologies such as Wi-Fi, Bluetooth® LE, ZigBee, Ethernet, LTE, and/or GSM, and/or may utilize a dedicated Ethernet connection, fiber optics, and/or other wired or wireless network connections.

Encryption/decryption module(s) 1260 may comprise a dedicated cryptographic processor, cryptographic hardware routines embedded in CPU(s) 1208; software instructions executed on the CPU(s) 1208 and stored in working memory 1240; a dedicated encryption/decryption dongle; and/or other techniques. Encryption schemes implemented by encryption/decryption module(s) 1260 include symmetric-key encryption and/or public-key encryption schemes. Encryption and decryption may also be performed by a Virtual Private Network (VPN) connection, Hypertext Transfer Protocol Secure (HTTPS) connection, and/or other secure network connection technique supported by the communication interface 1250.

Encryption and decryption functions may also be performed in conjunction with creation of messages by the transceiver 130 that may support wireless security protocols (e.g., Bluetooth® service-level security and device-level security, Wi-Fi Protected Access (WPA), and/or the like).

Any of the steps, functions, and operations discussed herein can be performed continuously and automatically.

The exemplary methods, systems, and devices of this disclosure have been described in relation to the transfer of RF energy to an antenna, such as using a feed block that is capacitively coupled to a label antenna. However, to avoid unnecessarily obscuring the present disclosure, the preceding description omits a number of known structures and devices. This omission is not to be construed as a limitation of the scope of the claimed disclosure. Specific details are set forth to provide an understanding of the present disclosure. It should, however, be appreciated that the present disclosure may be practiced in a variety of ways beyond the specific detail set forth herein.

Furthermore, while the exemplary embodiments illustrated herein show the various components in a single device, certain components can be in one or multiple devices. Thus, it should be appreciated, that the components can be combined into one or more devices.

Furthermore, it should be appreciated that the various links connecting the elements can be wired or wireless links, or any combination thereof, or any other known or later developed element(s) that is capable of supplying and/or communicating data to and from the connected elements. These wired or wireless links can also be secure links and may be capable of communicating encrypted information. Transmission media used as links, for example, can be any suitable carrier for electrical signals, including coaxial cables, copper wire, and fiber optics, and may take the form of acoustic or light waves, such as those generated during radio-wave and infra-red data communications.

While the flowcharts have been discussed and illustrated in relation to a particular sequence of events, it should be appreciated that changes, additions, and omissions to this sequence can occur without materially affecting the operation of the disclosed embodiments, configuration, and aspects.

A number of variations and modifications of the disclosure can be used. It would be possible to provide for some features of the disclosure without providing others.

In yet another embodiment, the systems and methods of this disclosure can be implemented in conjunction with a special purpose computer, a programmed microprocessor or microcontroller and peripheral integrated circuit element(s), an ASIC or other integrated circuit, a digital signal processor, a hard-wired electronic or logic circuit such as discrete element circuit, a programmable logic device or gate array such as PLD, PLA, FPGA, PAL, special purpose computer, any comparable means, or the like. In general, any device(s) or means capable of implementing the methodology illustrated herein can be used to implement the various aspects of this disclosure. Exemplary hardware that can be used for the present disclosure includes computers, handheld devices, telephones (e.g., cellular, Internet enabled, digital, analog, hybrids, and others), and other hardware known in the art. Some of these devices include processors (e.g., a single or multiple microprocessors), memory, nonvolatile storage, input devices, and output devices. Furthermore, alternative software implementations including, but not limited to, distributed processing or component/object distributed processing, parallel processing, or virtual machine processing can also be constructed to implement the methods described herein.

In yet another embodiment, the disclosed methods may be readily implemented in conjunction with software using object or object-oriented software development environments that provide portable source code that can be used on a variety of computer or workstation platforms. Alternatively, the disclosed system may be implemented partially or fully in hardware using standard logic circuits or VLSI design. Whether software or hardware is used to implement the systems in accordance with this disclosure is dependent on the speed and/or efficiency requirements of the system, the particular function, and the particular software or hardware systems or microprocessor or microcomputer systems being utilized.

In yet another embodiment, the disclosed methods may be partially implemented in software that can be stored on a storage medium, executed on programmed general-purpose computer with the cooperation of a controller and memory, a special purpose computer, a microprocessor, or the like. In these instances, the systems and methods of this disclosure can be implemented as a program embedded on a personal computer such as an applet, JAVA® or CGI script, as a resource residing on a server or computer workstation, as a routine embedded in a dedicated measurement system, system component, or the like. The system can also be implemented by physically incorporating the system and/or method into a software and/or hardware system.

Although the present disclosure describes components and functions implemented in the embodiments with reference to particular standards and protocols, the disclosure is not limited to such standards and protocols. Other similar standards and protocols not mentioned herein are in existence and are considered to be included in the present disclosure. Moreover, the standards and protocols mentioned herein, and other similar standards and protocols not mentioned herein are periodically superseded by faster or more effective equivalents having essentially the same functions. Such replacement standards and protocols having the same functions are considered equivalents included in the present disclosure.

The present disclosure, in various embodiments, configurations, and aspects, includes components, methods, processes, systems and/or apparatus substantially as depicted and described herein, including various embodiments, subcombinations, and subsets thereof. Those of skill in the art will understand how to make and use the systems and methods disclosed herein after understanding the present disclosure. The present disclosure, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease, and/or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments, configurations, or aspects for the purpose of streamlining the disclosure. The features of the embodiments, configurations, or aspects of the disclosure may be combined in alternate embodiments, configurations, or aspects other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the disclosure.

Moreover, though the description of the disclosure has included description of one or more embodiments, configurations, or aspects and certain variations and modifications, other variations, combinations, and modifications are within the scope of the disclosure, e.g., as may be within the skill and knowledge of those in the art, after understanding the present disclosure. It is intended to obtain rights, which include alternative embodiments, configurations, or aspects to the extent permitted, including alternate, interchangeable and/or equivalent structures, functions, ranges, or steps to those claimed, whether or not such alternate, interchangeable and/or equivalent structures, functions, ranges, or steps are disclosed herein, and without intending to publicly dedicate any patentable subject matter.

An antenna system according to one embodiment of the present disclosure comprises: a label antenna, wherein the label antenna comprises a conductive layer; an antenna coupler electrically coupled to the conductive layer of the label antenna; a feed block electrically coupled to a radio circuit; and a separation distance between the antenna coupler and the feed block, wherein the feed block and antenna coupler are capacitively coupled to transfer radio frequency (RF) energy from the radio circuit to the label antenna.

Aspects of the foregoing antenna system may include: wherein the label antenna conforms to a shape of a container, and wherein the label antenna is coupled to the container; wherein the label antenna is coupled to the container by wrapping the label antenna around the container; further comprises an adhesive layer to couple the label antenna to the container; wherein the shape of the container is a cylinder shape and the shape of the label antenna is a non-closed cylinder; wherein the shape of the container is a box shape and the shape of the label antenna is flat; wherein the separation distance further comprises a dielectric material within the separation distance; wherein the dielectric material comprises paper, mica, or glass; wherein the conductive layer of the label antenna comprises aluminum (Al), silver (Ag), gold (Au), copper (Cu), nickel (Ni), palladium (Pd), or platinum (Pt); and further comprising one or more tabs to electrically couple the antenna label to a ground plane of the radio circuit.

A radio system according to embodiments of the present disclosure comprise: a radio circuit, wherein the radio circuit generates a radio frequency (RF) signal; a matching network electrically coupled to the radio circuit, wherein the matching network is configured to resonate at a resonant frequency; and an antenna system, comprising: a label antenna, wherein the label antenna comprises a conductive layer; an antenna coupler electrically coupled to the conductive layer of the label antenna; a feed block; and a separation distance between the antenna coupler and the feed block, wherein the feed block and antenna coupler are capacitively coupled; wherein the matching network is electrically coupled to the feed block of the antenna system, and wherein the label antenna radiates the RF signal generated by the radio circuit.

Aspects of the foregoing radio system may include: wherein a length and a width of the label antenna are configured to match a resonant frequency of the label antenna to the resonant frequency of the matching network; wherein the matching network is configured to include the conductance of the capacitive coupling between the feed block and the antenna coupler; wherein the label antenna conforms to a shape of a container, and wherein the label antenna is coupled to the container; wherein the label antenna is coupled to the container by wrapping the label antenna around the container; further comprises an adhesive layer to couple the label antenna to the container; and wherein the shape of the container is a cylinder shape and the shape of the label antenna is a non-closed cylinder.

An electronic device according to another embodiment of the present disclosure comprises: a radio system, comprising: a radio circuit, wherein the radio circuit generates a radio frequency (RF) signal; a matching network electrically coupled to the radio circuit, wherein the matching network is configured to resonate at a resonant frequency; and an antenna system, comprising: a label antenna, wherein the label antenna comprises a conductive layer; an antenna coupler electrically coupled to the conductive layer of the label antenna; a feed block; and a separation distance between the antenna coupler and the feed block, wherein the feed block and antenna coupler are capacitively coupled; wherein the matching network is electrically coupled to the feed block of the antenna system, and wherein the label antenna radiates the RF signal generated by the radio circuit; a data storage comprising data to transmit on the radio system; a processor; and wherein the processor, upon determining one or more communication criterion are met, transferring, by the processor, data to the radio system to be transmitted to an endpoint device; receiving, by the processor, a response from the endpoint device; and performing, by the processor, an action corresponding to the response from the endpoint device.

Aspects of the foregoing electronic device may include: further comprising: one or more sensors, wherein data from the one or more sensors is used by the processor to determine if the one or more communication criterion are met; and wherein the one or more sensors is an acoustic sensor, a flow sensor, a force sensor, a pressure sensor, a position sensor, an optical sensor, or a presence sensor.

The present disclosure can provide a number of advantages depending on the particular configuration. These and other advantages will be apparent from the disclosure contained herein.

The phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

The term "a" or "an" entity refers to one or more of that entity. As such, the terms "a" (or "an"), "one or more," and "at least one" can be used interchangeably herein.

The term "automatic" and variations thereof, as used herein, refers to any process or operation, which is typically continuous or semi-continuous, done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material."

Aspects of the present disclosure may take the form of an embodiment that is entirely hardware, an embodiment that is entirely software (including firmware, resident software, micro-code, etc.) or an embodiment combining software and hardware aspects that may all generally be referred to herein as a "circuit," "module," or "system." Any combination of one or more computer-readable medium(s) may be utilized. The computer-readable medium may be a computer-readable signal medium or a computer-readable storage medium.

A computer-readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer-readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer-readable storage medium may be any tangible medium that can contain or store a program for use by or in connection with an instruction execution system, apparatus, or device.

A computer-readable signal medium may include a propagated data signal with computer-readable program code embodied therein, for example, in baseband or as part of a carrier wave. Such a propagated signal may take any of a variety of forms, including, but not limited to, electromagnetic, optical, or any suitable combination thereof. A computer-readable signal medium may be any computer-readable medium that is not a computer-readable storage medium and that can communicate, propagate, or transport a program for use by or in connection with an instruction execution system, apparatus, or device. Program code embodied on a computer-readable medium may be transmitted using any appropriate medium, including, but not limited to, wireless, wireline, optical fiber cable, RF, etc., or any suitable combination of the foregoing.

The terms "determine," "calculate," "compute," and variations thereof, as used herein, are used interchangeably and include any type of methodology, process, mathematical operation or technique.

What is claimed is:

1. An antenna system, comprising:

a label antenna, wherein the label antenna comprises a conductive layer;

an antenna coupler electrically coupled to the conductive layer of the label antenna;

a feed block electrically coupled to a radio circuit; and a separation distance between the antenna coupler and the feed block, wherein the feed block and antenna coupler are capacitively coupled to transfer radio frequency (RF) energy from the radio circuit to the label antenna.

2. The antenna system according to claim 1, wherein the label antenna conforms to a shape of a container, and wherein the label antenna is coupled to the container.

3. The antenna system according to claim 2, wherein the label antenna is coupled to the container by wrapping the label antenna around the container.

4. The antenna system according to claim 2, further comprises an adhesive layer to couple the label antenna to the container.

5. The antenna system according to claim 4, wherein the shape of the container is a cylinder shape and the shape of the label antenna is a non-closed cylinder.

6. The antenna system according to claim 4, wherein the shape of the container is a box shape and the shape of the label antenna is flat.

7. The antenna system according to claim 1, wherein the separation distance further comprises a dielectric material within the separation distance.

8. The antenna system according to claim 7, wherein the dielectric material comprises paper, mica, or glass.

9. The antenna system according to claim 1, wherein the conductive layer of the label antenna comprises aluminum (Al), silver (Ag), gold (Au), copper (Cu), nickel (Ni), palladium (Pd), or platinum (Pt).

10. The antenna system according to claim 1, further comprising one or more tabs to electrically couple the label antenna to a ground plane of the radio circuit.

11. A radio system, comprising:

a radio circuit, wherein the radio circuit generates a radio frequency (RF) signal;

a matching network electrically coupled to the radio circuit, wherein the matching network is configured to resonate at a resonant frequency; and an antenna system, comprising:

a label antenna, wherein the label antenna comprises a conductive layer;

an antenna coupler electrically coupled to the conductive layer of the label antenna;

a feed block; and a separation distance between the antenna coupler and the feed block, wherein the feed block and antenna coupler are capacitively coupled;

wherein the matching network is electrically coupled to the feed block of the antenna system, and wherein the label antenna radiates the RF signal generated by the radio circuit.

12. The radio system according to claim 11, wherein a length and a width of the label antenna are configured to match a resonant frequency of the label antenna to the resonant frequency of the matching network.

13. The radio system according to claim 11, wherein the matching network is configured to include a conductance of the capacitive coupling between the feed block and the antenna coupler.

14. The radio system according to claim 11, wherein the label antenna conforms to a shape of a container, and wherein the label antenna is coupled to the container.

15. The radio system according to claim 14, wherein the label antenna is coupled to the container by wrapping the label antenna around the container.

16. The radio system according to claim 14, further comprises an adhesive layer to couple the label antenna to the container.

17. The radio system according to claim 16, wherein the shape of the container is a cylinder shape and the shape of the label antenna is a non-closed cylinder.

18. An electronic device, comprising:

a radio system, comprising:

a radio circuit, wherein the radio circuit generates a radio frequency (RF) signal;

a matching network electrically coupled to the radio circuit, wherein the matching network is configured to resonate at a resonant frequency; and an antenna system, comprising:

a label antenna, wherein the label antenna comprises a conductive layer;

an antenna coupler electrically coupled to the conductive layer of the label antenna;

a feed block; and a separation distance between the antenna coupler and the feed block, wherein the feed block and antenna coupler are capacitively coupled;

wherein the matching network is electrically coupled to the feed block of the antenna system, and wherein the label antenna radiates the RF signal generated by the radio circuit;

a data storage comprising data to transmit on the radio system;

a processor; and wherein the processor, upon determining one or more communication criterion are met, transfers data to the radio system to be transmitted to an endpoint device;

receives a response from the endpoint device; and performs an action corresponding to the response from the endpoint device.

19. The electronic device according to claim 18, further comprising:

one or more sensors, wherein data from the one or more sensors is used by the processor to determine if the one or more communication criterion are met.

20. The electronic device according to claim 19, wherein the one or more sensors is an acoustic sensor, a flow sensor, a force sensor, a pressure sensor, a position sensor, an optical sensor, or a presence sensor.

* * * * *